US007383964B2

(12) United States Patent
Keller

(10) Patent No.: US 7,383,964 B2
(45) Date of Patent: Jun. 10, 2008

(54) CONTAINER WITH AT LEAST ONE VACUUM CHAMBER WITH AN ACCESS OPENING ESPECIALLY A BEVERAGE CONTAINER, SUCH AS A BEER BARREL ON THE LIKE

(75) Inventor: Max Keller, Dresden (DE)

(73) Assignee: Cool-System Bev. GmbH, Fuerth (DE)

( * ) Notice: Subject to any disclaimer, the term of this patent is extended or adjusted under 35 U.S.C. 154(b) by 583 days.

(21) Appl. No.: 10/916,233

(22) Filed: Aug. 11, 2004

(65) Prior Publication Data

US 2005/0034474 A1 Feb. 17, 2005

(30) Foreign Application Priority Data

Aug. 13, 2003 (DE) ..... 103 37 221
Mar. 5, 2004 (DE) ..... 10 2004 010 816

(51) Int. Cl.
*A47J 41/00* (2006.01)
*G01M 3/04* (2006.01)

(52) U.S. Cl. ..... 220/592.27

(58) Field of Classification Search ..... 62/371; 220/592.27

See application file for complete search history.

(56) References Cited

U.S. PATENT DOCUMENTS 1,511,852 A 10/1924 Wagner
1,551,778 A 9/1925 Altenberg
1,809,929 A 6/1931 Farmer
5,165,569 A * 11/1992 Furuhashi et al. ..... 220/592.19
5,809,786 A * 9/1998 Scudder et al. ..... 62/4
5,918,478 A * 7/1999 Bostic et al. ..... 62/371
6,209,343 B1 * 4/2001 Owen ..... 62/457.2
6,349,560 B1 * 2/2002 Maier-Laxhuber et al. 62/457.9
2001/0025510 A1 10/2001 Maier-Laxhuber et al.

FOREIGN PATENT DOCUMENTS

| | | |
|---|---|---|
| DE | 102 56 739 | 6/2004 |
| EP | 0 597 773 | 5/1994 |
| EP | 1 054 222 | 11/2000 |
| EP | 1 241 420 | 9/2002 |
| FR | 526 606 | 10/1921 |
| FR | 1 122 590 | 10/1924 |

* cited by examiner

*Primary Examiner*—Hezron Williams
*Assistant Examiner*—John Fitzgerald
(74) *Attorney, Agent, or Firm*—Jordan and Hamburg LLP

(57) ABSTRACT

Container with at least one vacuum enclosure with an access opening, especially a beverage container with a self-cooling device having a vacuum enclosure, such as a beer barrel or the like, the access opening of which is closed off by a closing mechanism after the vacuum is produced, a chamber being provided, which is downstream from the access opening and in which a valve element is disposed, which is opened during the generation of the vacuum and closed after the vacuum is generated, which chamber is filled with a medium containing an element or compound capable of diffusing, which diffuses if the chamber and, with that, the vacuum chamber is not closed off tightly, through the access opening.

24 Claims, 6 Drawing Sheets

CONTAINER WITH AT LEAST ONE VACUUM CHAMBER WITH AN ACCESS OPENING ESPECIALLY A BEVERAGE CONTAINER, SUCH AS A BEER BARREL ON THE LIKE

BACKGROUND OF THE INVENTION

The invention relates to a container with at least one vacuum chamber with an access opening, especially to a beverage container with a self-cooling device having a vacuum chamber, such as a beer barrel or the like, the access opening of which is closed off by a closing mechanism after the vacuum is produced.

A self-cooling beer barrel is known, for example, from the EP 1 054 222. Such a beer barrel has several chambers, namely, on the one hand, a bubble for holding the beverage, a chamber, which surrounds the bubble and forms an evaporator space, and a third chamber, which surrounds these two chambers and forms an absorber space, in which an absorbent, especially a zeolite granulate, is disposed. The evaporator space and the absorber space are divided from one another by a partition, in which a valve device is disposed. Water is used as evaporator material. In order to be able to cool the beverage, the absorber space, to begin with, is evacuated with the help of a heating step and dried. The zeolite granulate, contained in the absorber space, is brought to ambient temperature once again before the beverage is filled into the bubble or while it is already in the bubble. If now the valve device is opened before the barrel is tapped and, with that, the evacuated absorber space is connected with the evaporator space, water vapor flows from the evaporator space into the absorber space. An evaporation process takes place, which requires heat, which, in turn, is withdrawn from the beverage, so that the latter is cooled. This evaporation and absorption take place until the crystalline zeolite is saturated with water or the valve is closed and the transfer of water vapor is interrupted. In order to start the cooling process, the valve in the partition can be actuated from outside by a suitable mechanism with an opening lever or the like.

Such a beverage container is a reusable container, that is, the possibility exists of regenerating the self-cooling device and, after the bubble is filled, of operating the barrel once again. The key feature for the functioning of the self-cooling device is the vacuum in the vacuum chamber of the self-cooling device. This vacuum must be maintained for a long time, in order to be able to ensure the reversible evaporation operation and, by these means, the repeated usability of the container.

In the case of a container, known from the state-of-the-art described above, the vacuum chamber of the self-cooling device is closed off after the final evacuation using suitable means, usually a screw with a washer that is screwed into a threaded borehole. As a further precaution, a cover is welded tightly over the closing screw. However, these means do not necessarily ensure that the barrel actually is closed tightly and does not have a leak, because there is no possibility of measuring the vacuum produced after the access opening of the container has been closed off.

However, this is a problem, which exists not only for the container described above in the form of a self-cooling beverage barrel, but also in the case of other one-chamber or multichamber vacuum containers, which are closed off after the vacuum is produced.

SUMMARY OF THE INVENTION

It is therefore an object of the invention to indicate a container, which offers the possibility of checking for leaks even after the vacuum chamber is closed off.

To solve this problem pursuant to the invention, a container of the type named above is provided with a chamber, which is downstream from the access openings and in which a valve element is disposed, which is opened when the vacuum is produced and closed after the vacuum is produced, the chamber being filled with a medium containing an element or a compound capable of diffusing through the access opening in the event that the chamber and, with that, the vacuum chamber is not sealed tightly.

The vacuum chamber, downstream from the chamber, which, in turn, is downstream from the access opening can be evacuated over the valve that is provided there, it being possible to evacuate this vacuum chamber only over the chamber. After the desired vacuum is attained, the chamber is closed off by the valve element. This means that the vacuum chamber is sealed off from the access opening by this valve element. The chamber itself is now filled with a liquid, containing the element capable or the compound, capable of diffusing, this liquid remaining in the chamber after the opening is closed off tightly. If the chamber is closed off tightly, the element or compound, capable of diffusing, cannot emerge from the chamber over the access opening to the outside. In the case of a leakage, however, the element or compound, capable of diffusing, emerges, even though only in a small concentration, and can be detected by using suitable measuring equipment, which is sensitive to the element or compound used. A container is regarded as tight if the leak rate is not greater than $1\times10^{-7}$ mbar.

Accordingly, the inventive container can be checked very easily for leaks, any leak showing up very quickly after the access opening is closed off. Moreover, any leak in the seal can be repaired in that the seal is opened once more and, if necessary after the liquid in the chamber is exchanged while the chamber is sealed by the valve element, closed off once again.

A liquid, preferably water, is advisable the used as medium. Preferably, helium is used as element capable of diffusing.

Particularly with respect to the space relationships of the beverage barrel described above, the chamber itself advisably is tubular and fastened with one end in the region of the access opening, the valve element being provided at the other end. The chamber itself, in particular, the tube forming the chamber, may be fastened, in the case of a beverage container, at a threaded sleeve, which defines the access opening and into the thread of which a screw for closing off the chamber and, with that, for closing off the vacuum chamber, can be screwed.

In an advantageous further development of the inventive concept, an optionally also tubular second chamber optionally surrounds the tubular first chamber. The second chamber communicates with the first chamber in a region below the valve element and has at least one air inlet opening on the upper side, especially in the region where it is fastened. For this development of the invention, a double-chamber arrangement is used, the air, which is to be aspirated, initially being evacuated by way of the air inlet openings in the upper region of the outer second chamber, subsequently passing through the outer second chamber and entering the first chamber through the passage connection. Any evacuation directly into the first chamber is precluded, since the two chambers are closed off at the bottom, so that the air can only be drawn in over the air inlet opening. By these means, it is avoided that, when the air is evacuated, residual air remaining at the lower end of only a first chamber, at the lower end collects in the region of the upper end outside of the chamber, which is disadvantageous for the vacuum. Circumstances, unfavorable for flow, may be present there and permit only a partial evacuation. These circumstances are advantageously avoided owing to the fact that the air, which is to be evacuated particularly in this region, is evacuated.

For this double-chamber configuration, the first as well as the second chamber may be disposed at the upper side jointly at the threaded sleeve and, at the lower side, at a common holding part having a chamber connection. In particular, the holding part comprises a sealing seat of the valve element. The two chambers can be closed off at the bottom over the holding part.

For the inventive container, it is also appropriate furthermore if the sealing means has a covering cap, which covers the sealing screw and is welded at the edge. Since beverage containers, in particular, are handled relatively carelessly during transport, filling or use, this additional safety measure is appropriate, even though the valve element, already additionally disposed in the interior of the chamber, represents a further protection against a possible leakage.

Any valve, which permits the chamber opening, leading to the vacuum chamber, to be opened and closed reversibly and can be mounted in the chamber, may be used as valve element. Advisably, it is constructed as a ball valve with a ball, which may be moved with regard to a sealing seat. In order to ensure a secure and tight contact between the ball and the sealing seat, the possibility exists of forming the ball from a deformable material and the sealing seat from an undeformable material or vice versa, that is, of forming the ball from an undeformable material and the sealing seat from a deformable material. Alternatively, the possibility exists of forming both from a deformable material, optionally with different behavior.

The deformable material advisably is a material based on silicone. However, any other elastic sealing material can also be used. The undeformable material advisably is a metal.

In order to avoid that the ball of the ball valve is moved during the evacuation of the chamber from its sealing seat into the chamber because of the activity of the pump, which is coupled to the access opening, reaches the region of the access opening and closes the latter off unintentionally, so that the vacuum can no longer be increased, the possibility exists of holding the ball by suitable restraining measures in the chamber in a position close to the seat, for example, by one or more inwardly protruding holding webs or the like. It is, however, appropriate that the chamber is constructed in such a manner in the region of the access opening or if means are provided there, which are constructed in such a manner that, during the generation of the vacuum, the ball, which is movable in the chamber, does not seal the access opening. For this purpose, the tubular chamber advisably may be bent in the vicinity of the access opening. This bend represents a structural restraining means, since the ball cannot pass it, even though the chamber is open to the vacuum chamber.

Alternatively to using a ball valve, it is also possible to use a needle valve with a needle, which can be moved with respect to a sealing seat and by means of which secure sealing is likewise achieved. In an advantageous development of the invention, whether it be a single-chamber or double-chamber construction, the sealing seat has a central aperture with a sealing ring, which interacts with a needle sealing seat for sealing purposes and through which the needle passes. A holding part with an aperture, positioned below the sealing seat, is provided with an internal thread, into which the needle can be screwed with an external thread, which is provided in the region of the lower end of the needle. This needle valve can repeatedly be opened and closed reversibly, that is, several evacuation steps can be carried out. As required, the needle valve can be positioned between different positions, in which it either interacts with the thread or is screwed out of the thread. Advisably, a device for engaging a tool, by means of which the needle is screwed, is provided at the upper end of the needle. Advisably, the length of the internal thread on the holding part and the external thread at the needle and the length of the needle seat should be such, that the needle can be screwed through the thread and, after the needle is screwed through the thread, the seal remains retained. Advisably, the sealing ring itself should consist of a deformable material.

Aside from relating to the container itself, the invention also relates to a method for producing a vacuum in a container of the type described above, which has a vacuum chamber, and for checking the container for leaks. The method of checking the container for leaks comprises the steps of:

- evacuating the vacuum chamber through an enclosure, downstream from the access opening, by means of a pump, which is connected to the access opening, until the desired vacuum is reached,
- uncoupling the pump from the access opening with the valve device in the enclosure closed,
- filling the enclosure with a medium containing an element or a compound capable of diffusing,
- closing off the access opening with closing means, and
- measuring the escape of the element or compound, capable of diffusing, through the closed access opening, by using measuring equipment, which is sensitive to the element or compound.

As medium, a liquid, particularly water, can be used as described. The liquid or water is enriched preferably with helium as element capable of diffusing or is enriched after it is filled into the chamber. As described, the access opening should be closed before leakage measurements are carried out. For this purpose, advisably a closing-off screw is screwed into a threaded opening, which defines the access opening, after which a covering cap, completely covering the closing-off screw completely, is welded on all around.

Further advantages, distinguishing features and details of the invention arise out of the example, described in the following, as well as from the accompanying drawings.

DESCRIPTION OF THE PREFERRED EMBODIMENTS

Figure 1:
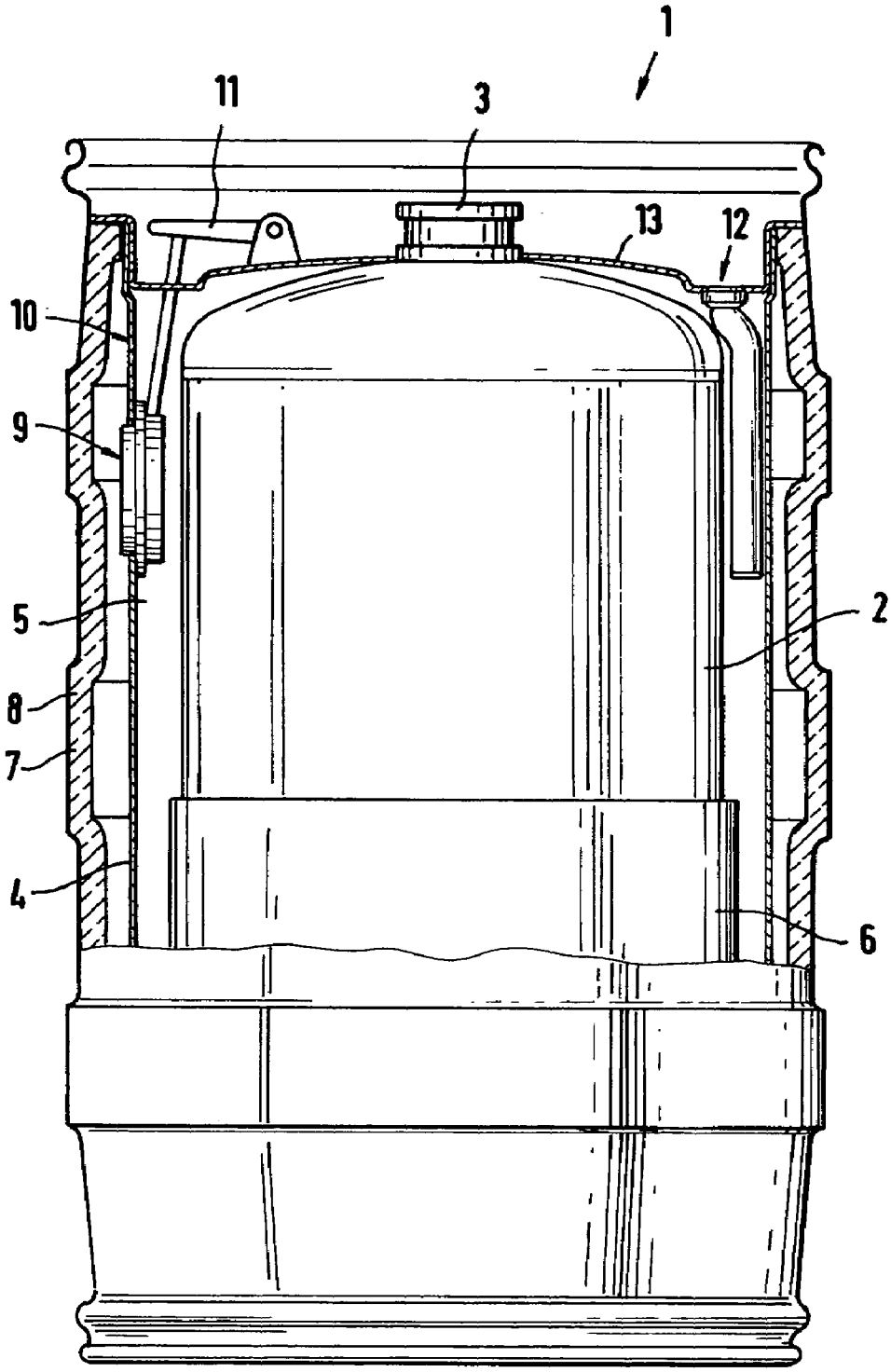
FIG. 1 shows a diagrammatic representation of an inventive container, partially in a sectional view.

FIG. 1 shows an inventive container 1 in the form of a barrel. By way of example, the bubble 2 of the barrel is shown, into which a beverage or the like, such as beer, can be filled over a filling connection 3. Furthermore, a partition 4 is shown, by means of which an evaporator space 5, in which an evaporator 6, which is saturated with water, is separated from an absorber space 7, which is filled with an absorbing material 8, such as zeolite. A valve device 9, the details of which are not shown in FIG. 1, is disposed in this partition 4. The valve device may, for example, be one known from the German patent application DE 102 56 739. Furthermore, the mechanism 10, by means of which the valve device 9 may be actuated, is shown. The actuation is accomplished by an opening and closing lever 11, which is accessible manually, from the outside, to the operator. The valve device may be opened and closed and the self-cooling process started or ended through the use of the closing lever 11. In the course of this self-cooling process, the passage from the evaporator space 5 to the absorber space 7, in which, at the start of the self-cooling process, there is a vacuum, is open. The water stored in the evaporator is evaporated. Energy is required for this evaporation and withdrawn in the form of heat from the beverage in the bubble 2. The evaporating water passes through the valve device 9 into the absorber space and is absorbed by the absorbant 8, that is, for example, by the zeolite. The evaporation process and, with that, also the self-cooling, continues until either the absorbant is saturated completely with water or the valve device 9 is closed manually by the user.

Figure 2:
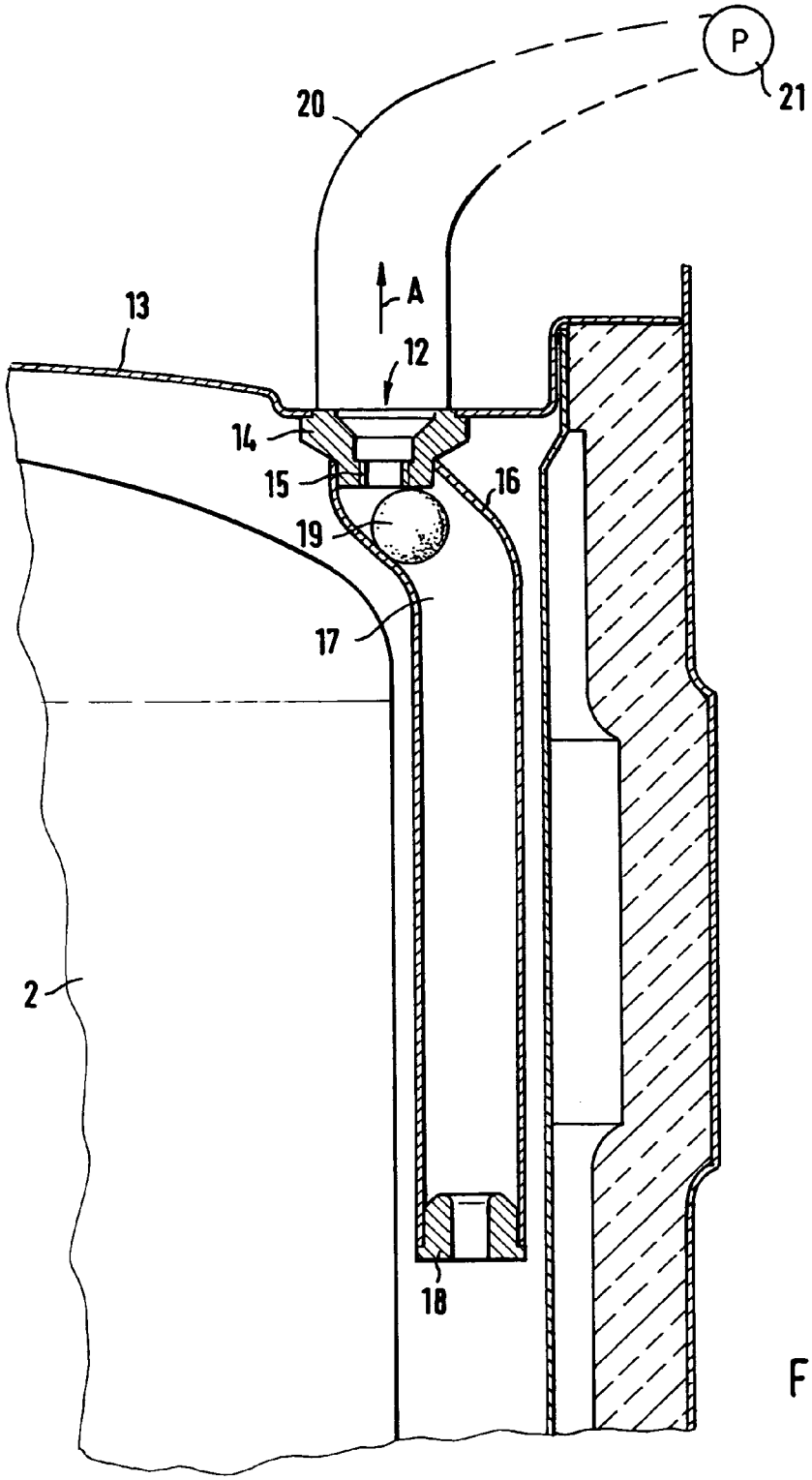
FIG. 2 shows an enlarged sectional view of the container of FIG. 1 for representing the chamber, downstream from the access opening during the evacuation.
Figure 3:
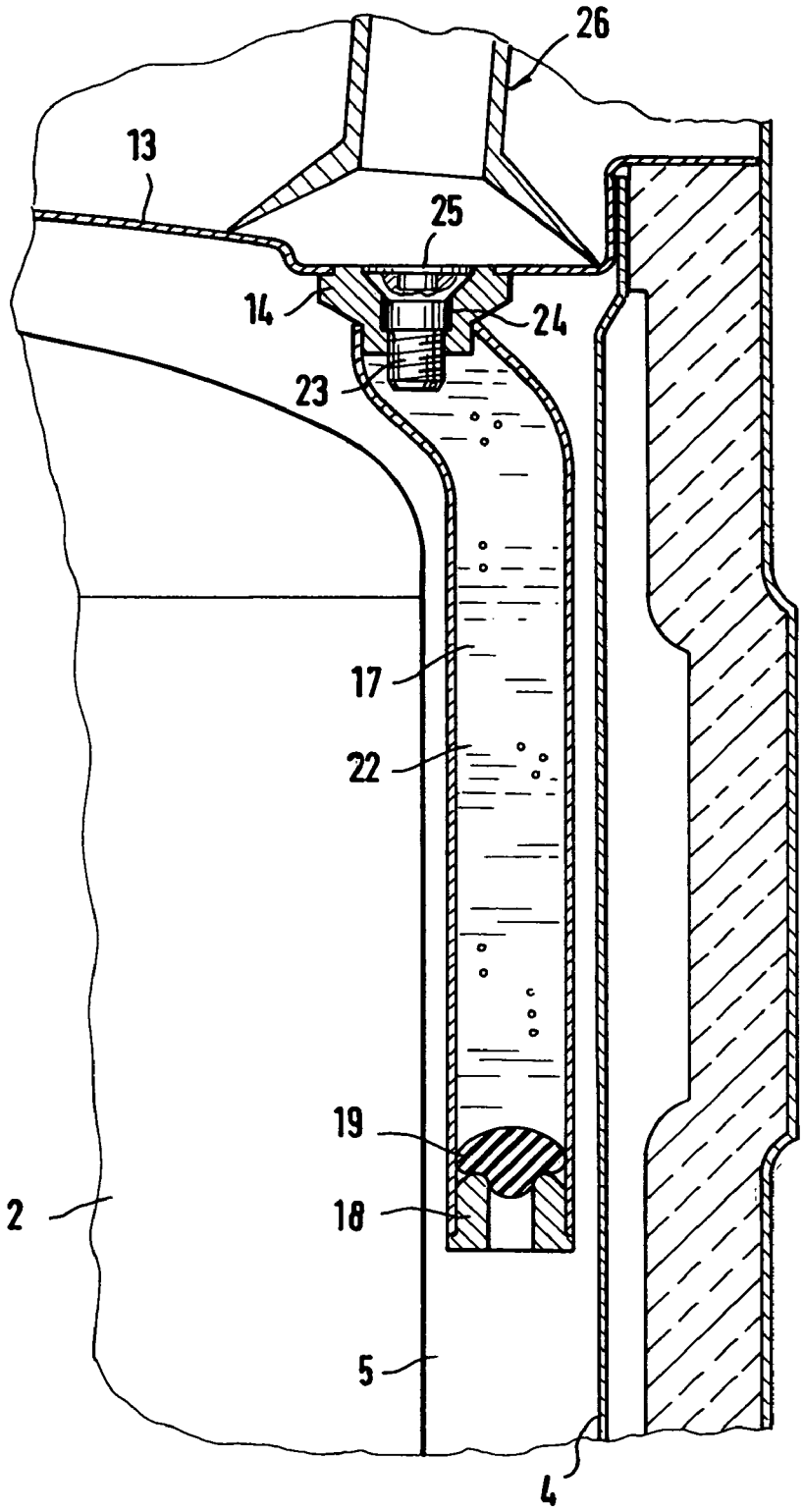
FIG. 3 shows a view, corresponding to that of FIG. 2, after the vacuum chamber is closed off tightly.

Furthermore, in the right upper portion of FIG. 1, the access opening 12 is shown, over which the evaporator space 5 and optionally also the absorber space 7 is evacuated with the valve device 9 open; each of the spaces 5 and 7 represents a vacuum chamber. FIGS. 2 and 3 show a detailed view of this region. On the one hand, the lid 13 of the container 1 of FIG. 1 as well as the access opening 12, which is formed by a threaded sleeve 14, provided with an internal thread 15, are shown. The threaded sleeve 14 is welded firmly to the lid 13. A bent pipe 16, which forms a chamber 17 downstream from the access opening 12, is welded to the lower connecting piece section of the threaded sleeve 14. The pipe 16 and, with the chamber 17, extend into the region of the evaporator space 5. A sealing seat 18, which interacts with a ball 19 in a manner yet to be described in the following, is firmly connected at the lower end with the pipe 16. In conjunction with the ball 19, the sealing seat 18 forms a ball valve, over which access to the vacuum space 5 can be opened and closed.

FIG. 2 is a diagrammatic representation of the arrangement during the generation of the vacuum, while the evaporator space 5 and optionally also the absorber space 7 are being evacuated. For this purpose, an evacuation pump 21, over which the air from the spaces 5, 7 is evacuated, as indicated by arrow A, is connected to the access opening 12 over suitable connecting means 20. Because of the reduced pressure, to which it is subjected, the ball 19 is pulled upward. Because of the bent shape of the pipe 16 and, with that, of the chamber 17 in the upper region in the vicinity of the access opening 12, the ball 19 is held in a position, in which it cannot seal the access opening 12, so that further evacuation is not prevented. Since the ball valve is opened in this way, the vacuum chamber, in the form of the evaporator space 5 and optionally of the absorber space 7, may be evacuated. This evacuation is continued until the pressure in the vacuum chamber is equal to the pressure produced by the pump. When this pressure is reached, the ball 19 sinks down under force of gravity and engages the sealing seat 18. Because of the vacuum existing in the vacuum chamber, the ball 19, which consists of a silicone material or silicone, is deformed as shown in FIG. 3. The sealing seat 18 itself preferably consists of metal. Likewise, the configuration can also be the reverse, so that the ball 19 consists of a metal, whereas the sealing seat 18 consists of a deformable material, such as silicone. Access from the chamber 17 to the vacuum chamber, which in this case is the evaporator space 5, is now closed off in this manner. The pump 21 is now uncoupled. Subsequently (FIG. 3), a liquid, preferably water 22, is filled into the chamber 17 until the latter is filled completely. After it is filled into the chamber 17, the water is enriched with an element or compound, capable of diffusing. Preferably, helium is used here. Subsequently, a closing-off screw 23, in this case a washer-head screw, with a gasket 24, is screwed firmly into the threaded sleeve 14. By so doing and since the chamber 17 is filled with water, water is displaced or compressed because of the length of the closing-off screw 23, so that the hydraulic pressure on the deformed ball 19 is intensified. In the next step, a covering cap 25 is placed upon the closing-off screw 23 and welded to the threaded sleeve 14 at the edge, in order to realize a further seal.

In this way, a liquid, enriched with an element capable of diffusing, such as helium, is enclosed under pressure in the chamber 17. If, contrary to expectations, the seal at the access opening 12 leaks and there is leakage in the area of the sealing-off screw 23 and/or the covering cap 25, the helium can diffuse to the outside through this leak. This can be detected by using measuring equipment 26, a so-called leak detector, which is shown here only as an example. Should a leak be detected, the seal can be opened. For this purpose, the welded-on covering cap 25 should be tapped centrally and subsequently removed with a milling cutter, after which the closing-off screw 23 can be screwed out. After the closing-off screw 23 or the seal 24 is replaced, the closing-off screw 23 can be set once again, optionally after water is added and enriched once more. Moreover, it is possible to re-evacuate in this way, should it turn out in the operation of the barrel that the vacuum, no matter for what reason, no longer is adequate.

The chamber, provided pursuant to the invention, permits repeated opening and closing, which is required during the manufacture of the beverage container described with the self-cooling device. The manufacturing process is as follows.

The pipe 16, the threaded sleeve 14 and the sealing seat 18 form a pre-assembled unit, which is welded into the lid 5 by way of the threaded sleeve 14 at a suitable time. After leakage tests of the weld connection to date of the container part defining or forming the boundary of the vacuum chamber in the form of the evaporator space or the absorber space have been carried out, the deformable ball 19 is pressed into the chamber 17 over the access opening 12. The pump 21 is now coupled to the access opening 12 and the evaporator space 5 and optionally also the absorber space 7 are evacuated. In so doing, as already described, the ball 19 migrates upward, so that the chamber valve is open. When the desired vacuum is reached, the ball 19 once again drops down and contacts the sealing seat 18, closing the valve.

Chamber 17 is now filled to the edge with cold water. This protects the valve, consisting of the ball 19 and the sealing seat 18 from becoming overheated in the following regeneration process. Subsequently, the closing-off screw 23 is screwed in, so that the water in the chamber 17 is displaced and exerts a hydraulic pressure is exerted in the chamber on the ball 19.

In a next step, the container is regenerated. The absorber space or the absorber material is saturated with water. The container is heated from the outside, so that the water evaporates from the absorber material and migrates over the valve device, which now is open, into the evaporator space, and saturates the evaporator 6. In so doing, pressure up to about 1000 mbar is built up in the container chamber. At the same time, a counter-pressure is built up by the extension of the water column over the ball 19, which closes off the ball valve. Should there nevertheless be a leak in this area, only water would flow from the chamber 17 into the vacuum chamber; the vacuum produced would essentially be unchanged.

After the regeneration, the valve device is closed and the actual final evacuation is carried out. For this purpose, the closing-off screw 23 is screwed out under the vacuum existing vacuum over the pump 21 or over an appropriately constructed vacuum bell jar and the chamber 17 is opened. This causes the gas pressure in the evaporator space 5 to raise the ball 19 somewhat, so that the water in the chamber 17 can flow into the evaporator space 5. Subsequently, the ball drops once again onto the sealing seat 18 and closes off this opening completely.

Water is filled once again into the chamber 17 and subsequently enriched with helium. Finally, the closing-off screw 23 is screwed in once again and tightened and the covering plate 25 is subsequently welded on. The last leak test can now be carried out.

Figure 4:
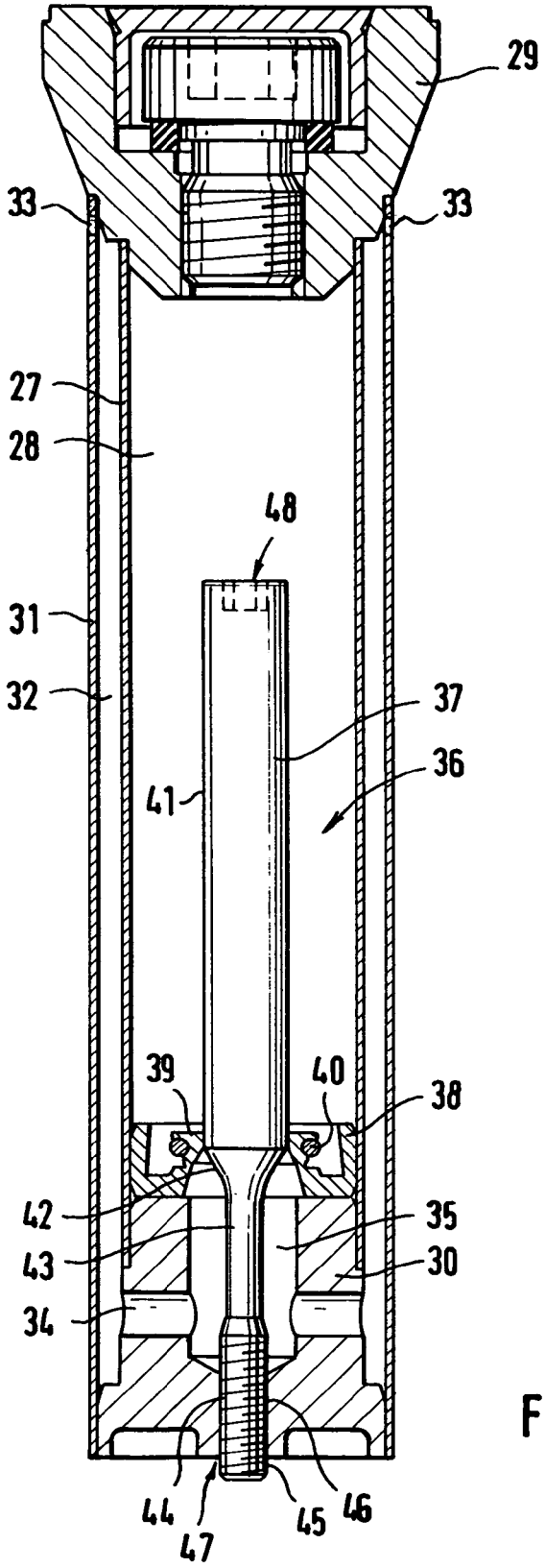
FIG. 4 shows a diagrammatic representation of the construction of a chamber and valve of a second embodiment before the evacuation.

FIG. 4 shows a further embodiment of chambers and valve. A first pipe 27 is also shown here. It forms the boundary of a tubular chamber 28 and is disposed with its upper end at a threaded sleeve 29 and its lower end at a holding part 30, the function of which will still be dealt with in the following. The first chamber 28 is surrounded by a second external pipe 31, which forms the boundary of a second external chamber 32 between the first pipe 27 and the second pipe 31. The second pipe 31 is also disposed at the top of the threaded sleeve 29 and the bottom at the holding part 30. In the upper region, where the second pipe 31 is fastened to the threaded sleeve, several air inlet openings 33 are provided, over which air can be aspirated into the second chamber during the evacuation.

The holding part 30 seals the two chambers 28, 32 at the bottom. It has an opening 34 for the passage of air from the second chamber 32 into a chamber 35 of the holding part. Furthermore, the valve element 36, which is constructed here as a needle valve, is positioned at the holding part 30. This valve element 36 comprises, on the one hand, a needle 37 and, on the other, a sealing seat 38 with a sealing ring 39, which is acted upon towards the inside by a spring lock washer 40. The diameter of the sealing ring 39 is such that the sealing seat 41 for the needle 37, formed by its elongated external periphery, can be taken up positively in the sealing ring 39.

The elongated sealing seat 41 of the needle 37 is followed by a conically tapering section 42, which goes over into a connecting section 43, adjoining which there is a section 44 with an external thread 45. This external thread engages the internal thread 46 of an aperture 47 at the holding part 30 and can thus be screwed into the internal thread 46.

Figure 5:
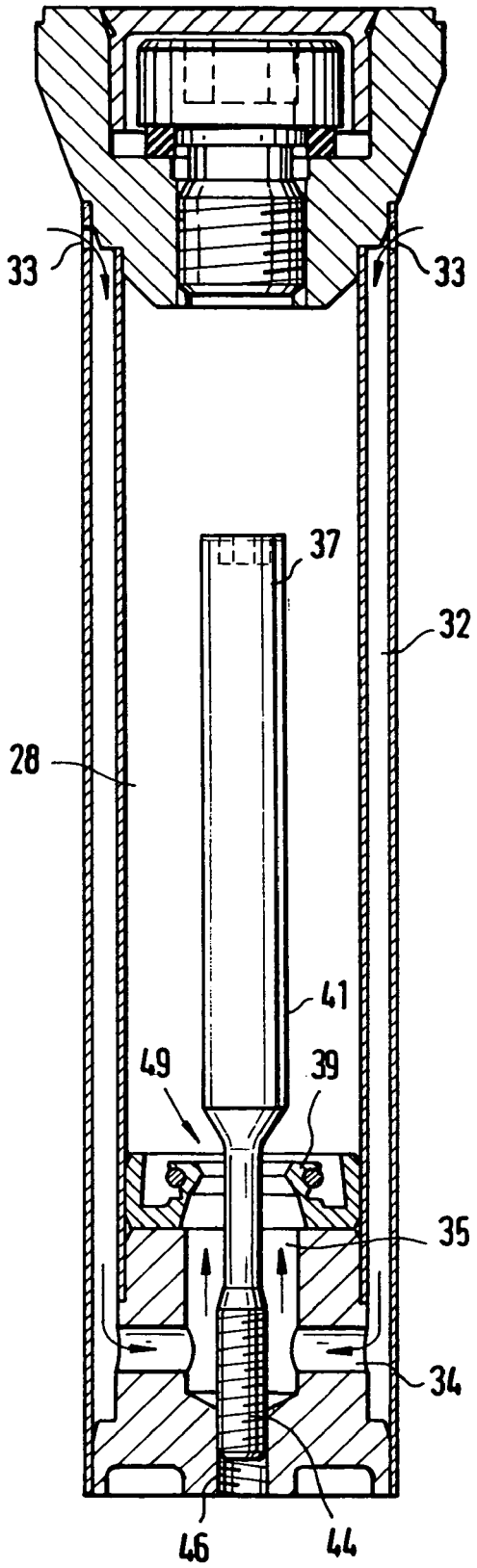
FIG. 5 shows the view of FIG. 4 with a valve in the evacuating position.

Starting out from the arrangement shown in FIG. 4, the needle 37 is first of all screwed upward for the evacuation using a tool, the details of which are not shown and which engages a device 48, which is provided at the upper end of the needle 37, until the needle sealing seat 41 is loosened from the sealing ring 39 (see FIG. 5). The sealing ring 39, which consists of silicone, as does, appropriately, the whole of the sealing seat 38, springs inward somewhat. Evidently, however, the valve is opened and air, after the pump is set down, can flow over the air inlet openings 33 at the upper side, as indicated by the arrow, into the outer second chamber 32 and, from there, over the air passage opening 34 into the inner chamber 35 on the holding part and, through this chamber 35 and over the valve opening 49 into the first chamber 28 and, from there, reach the pump. It is evident that the needle 37 continues to be screwed into the thread 46.

The evacuation is carried out until the desired vacuum is reached. Subsequently, with the pump still in place, the needle 37 is screwed down over the device 48 for engaging the tool, the details of which are not shown, until the external thread 44 leaves the internal thread 46, so that the needle slips through the aperture 47 downward into the position shown in FIG. 6.

The water, enriched with the element or compound capable of diffusing, is now filled in, after which, in the manner already described above, the threaded sleeve is closed at the top by the closing-off screw and subsequently welded tight. When the thread 44 is screwed out of the thread 46, the needle 37 does not necessarily move all the way to the bottom; its movement thus is not limited by the expanding conical section 42. This offers the advantage that the needle 37 is somewhat moveable vertically, so that, when the water in the chamber 28 expands somewhat due to an increase in temperature, the needle can compensate for the pressure and yields somewhat in the downward direction.

If now the valve is opened once again, for example, for the purpose of regenerating the evaporator, the closing-off screw is opened and the needle 37 is taken hold of by the tool and screwed upward once again into the evacuation position shown in FIG. 5. It is thus possible at all times to actuate the valve device repeatedly.

Figure 6:
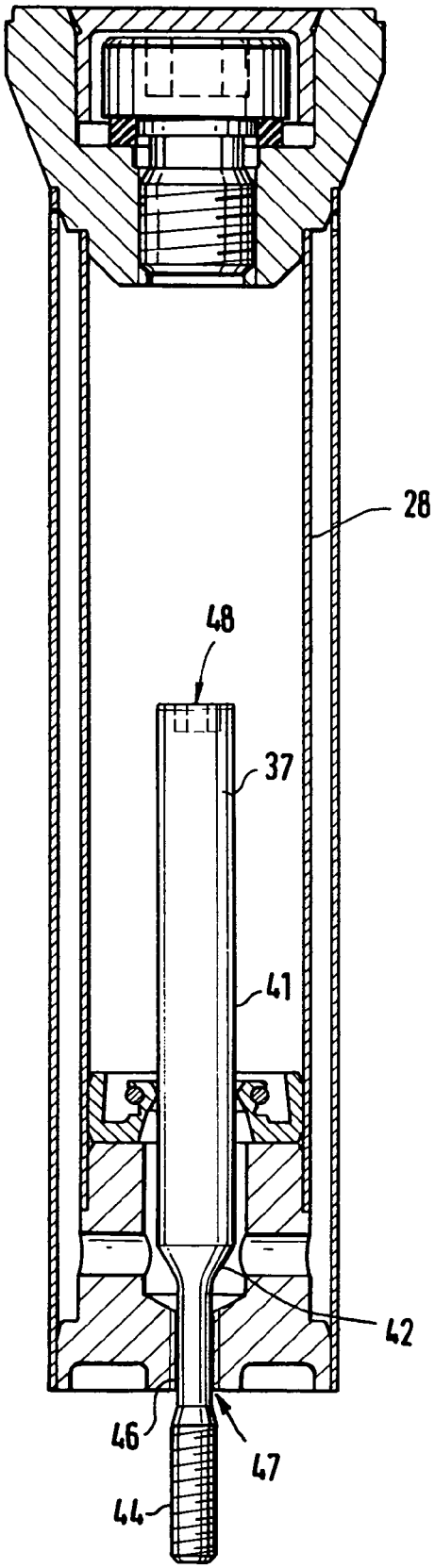
FIG. 6 shows the arrangement of FIG. 5 with a valve in the sealing position after the evacuation.

Although, as shown in FIGS. 4 to 6, it is not absolutely essential that the sealing seat 38 is disposed directly on the holding part 30, such an arrangement is nevertheless very advisable in order to avoid any cavities, in which residual gas could accumulate.

What I claim is:

1. Container comprising at least one vacuum chamber with an access opening, the access opening being closed off by a closing mechanism after a vacuum is produced, an enclosure downstream from the access opening and in which a valve element is disposed, said valve element being opened during the generation of the vacuum and closed after the vacuum is generated, said enclosure being filled with a medium containing an element or compound capable of diffusing, which diffuses if the enclosure and, with that, the vacuum chamber are not closed off tightly, through the access opening.

2. The container of claim 1, wherein the medium is a liquid.

3. The container of claim 1, wherein the medium is water.

4. The container of claim 1, wherein the medium is enriched with helium as the element, capable of diffusing.

5. The container of claim 1, wherein the enclosure is tubular and fastened at one end in the region of the access opening and, at the other end of which, the valve element is provided.

6. Container according to claim 1, wherein said container is a beverage container with a self-cooling device.

7. Container according to claim 1, wherein said container is a beer barrel.

8. The container of claim 1, wherein the enclosure is fastened at a threaded sleeve, which defines the access opening and in which the thread of a closing-off screw is screwed.

9. The container of claim 8, comprising a covering cap, which covers the closing-off screw and is welded at the edge.

10. The container of claim 1, wherein said enclosure is a first tubular enclosure, and further comprising a second tubular enclosure, surrounding the first tubular enclosure, and communicating in a region below the valve element with the first said enclosure and having at an upper side, at least one air inlet opening.

11. The container of claim 10, wherein the second enclosure is disposed at the upper side jointly at a threaded sleeve and, at the lower side, at a common holding part, having an enclosure connection and comprising a sealing seat for the valve element.

12. The container of claim 1, wherein the valve element is a ball valve with a ball, which may be moved with respect to a sealing seat.

13. The container of claim 12, wherein the ball is constructed from an undeformable material and the sealing seat from a deformable material.

14. The container of claim 12, wherein the sealing seat and the ball are constructed from a deformable material.

15. The container of claim 12, wherein the enclosure, in the region of the access opening, is constructed in such a manner that the ball, movable in the chamber during the generation of the vacuum, does not seal the access opening.

16. The container of claim 12, wherein the enclosure is a tubular enclosure which is bent in the vicinity of the access opening.

17. The container of claim 12, wherein the ball is constructed from a deformable material and the sealing seat is constructed from an undeformable material.

18. The container of claim 17, wherein the deformable material comprises silicone and the undeformable material comprises a metal.

19. The container of claim 1, wherein the valve is a needle valve with a needle, which may be moved with respect to a sealing seat.

20. The container of claim 19, wherein the sealing seat has a central aperture with a sealing ring, which interacts with a needle sealing seat of the needle for the purpose of sealing and through which the needle passes, a holding part with an aperture with an internal thread, into which the needle can be screwed with an external thread provided in the region of the lower end of the needle being positioned below the sealing seat.

21. The container of claim 20, wherein a device for engaging a tool for screwing the needle is provided at the upper end of the needle.

22. The container of claim 20, wherein the length of the internal thread and the external thread at the holding part and the length of the needle sealing seat are such, that the needle can be screwed through the external thread and that the seal is retained after the needle is screwed through.

23. The container of claim 20, wherein the sealing ring is constructed from a deformable material.

24. The container of claim 23, wherein the sealing seat is constructed from a deformable material.

* * * * *